US005127709A

United States Patent [19]

Rubinstein et al.

[11] Patent Number: 5,127,709

[45] Date of Patent: Jul. 7, 1992

[54] QUICK RELEASE WHEELCHAIR ATTACHMENT BRACKET

[75] Inventors: Stanley Rubinstein, Sepulveda; Terry D. Robuck, Simi Valley, both of Calif.

[73] Assignee: Freedom Designs, Inc., Simi Valley, Calif.

[21] Appl. No.: 643,027

[22] Filed: Jan. 18, 1991

[51] Int. Cl.[5] ..... A47C 7/00

[52] U.S. Cl. ..... 297/444; 297/DIG. 4; 297/440; 248/229

[58] Field of Search ..... 297/444, 440, 442, 443, 297/230, 231, DIG. 4, 353, 383, 412, 463, 148, 153, 251, 410; 403/233, 235; 248/301, 304-306, 201, 219.1, 227, 229, 230, 231.3, 231.5, 231.2

[56] References Cited

U.S. PATENT DOCUMENTS 1,345,785 7/1920 Koch ..... 297/231
3,700,282 10/1972 Rowland ..... 297/440
4,493,488 1/1985 Panaia et al. ..... 297/DIG. 4 X
4,629,246 12/1986 Fulton ..... 297/440 X
4,898,425 2/1990 Mundy ..... 297/444
5,062,677 11/1991 Jay et al. ..... 297/DIG. 4

FOREIGN PATENT DOCUMENTS 372516 5/1932 United Kingdom ..... 297/231

*Primary Examiner*—Kenneth J. Dorner
*Assistant Examiner*—James M. Gardner
*Attorney, Agent, or Firm*—Marvin E. Jacobs

[57] ABSTRACT

A bracket to easily fasten detachable parts such as seats and backs to a wheelchair with J-shaped hooks or brackets that partially encircle the wheelchair frame tubes. A separate clamp assembly is more permanently clamped to the tube adjacent to each J-bracket. A swing arm pivoted on each clamp assembly is rotated into a position over the encircling portion of the J-bracket so as to both trap the bracket against the clamp and against the tube. Quick release and reattachment is achieved simply by rotating the swing arms off or on the J-hooks.

16 Claims, 4 Drawing Sheets

Fig. 5.
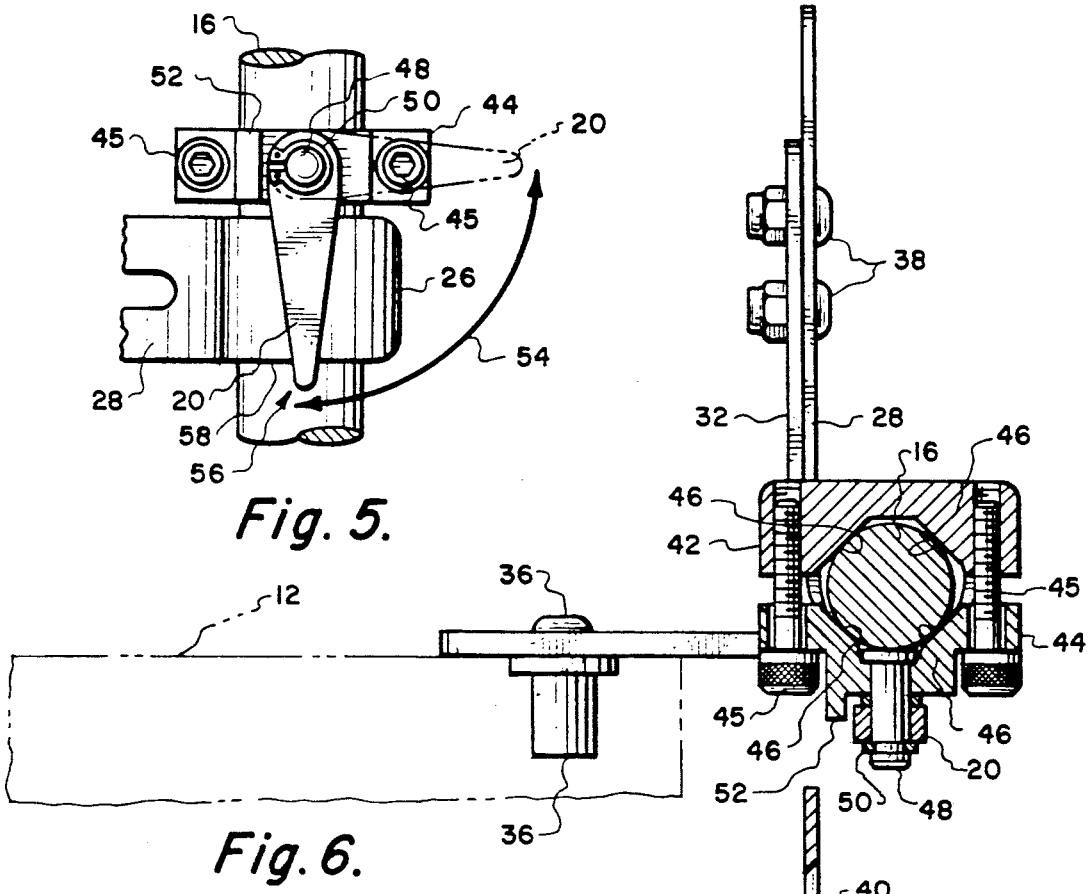
Fig. 6.
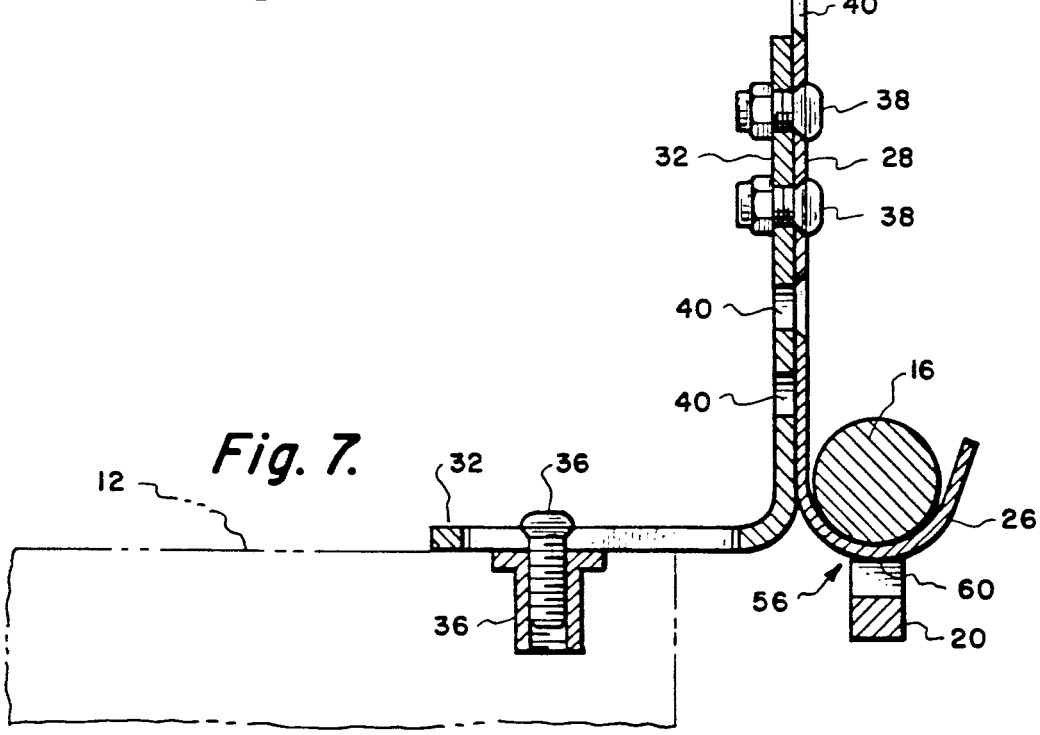
Fig. 7.

QUICK RELEASE WHEELCHAIR ATTACHMENT BRACKET

TECHNICAL FIELD

The present invention relates to detachable wheelchair components, such as seats and backs, that are removable so that the wheelchair may be easily folded and stored. Specifically, a quick release bracket is disclosed that solidly clamps the component to any wheelchair frame and still allows fast and easy removal.

BACKGROUND OF THE INVENTION

Wheelchairs are used by people with a wide variety of disabilities. As a consequence, parts that are likely to be specialized to the patients needs, such as seats, backs, and footrests, are usually manufactured separately and adapted to be mounted to a more standardized frame. In addition, it is desirable to be able to easily remove these attachable parts during use of the wheelchair to facilitate storage of the chair or conversion of its use to another patient.

The thin lightweight tubing that forms the frames of wheelchairs should not have holes drilled or otherwise introduced into it which would compromise its strength. Hence, the best and normal method of attachment is to provide a clamping mechanism around the outside of the tubular frame members. Prior art attachment schemes do indeed generally clamp around the wheelchair frames. This approach, however, is complicated by the fact that chair frames are manufactured in a range of diameters from 0.75 to 1.25 inches. Since backs and seats are often supplied by independent manufacturers, the need arises for an attachment system that allows easy compatibility with a variety of different frames from different sources.

Prior art clamps use conventional yokes about the frames that are bolted together in a familiar way. They are bulky, heavy, and difficult to use. Special tools may even be required to effect attachment of the component to the frame. Thus, it is not possible to easily and quickly remove the attached parts. The present invention overcomes these disadvantages with a quick release bracket design that is light, strong, and adaptable to a variety of frame shapes and diameters.

SUMMARY OF THE INVENTION

Briefly, the instant invention contemplates attaching seats, backs, or other accessories to a wheelchair frame with J-shaped hooks or brackets that partially encircle the frame tubes. A separate clamp assembly is more permanently clamped to the tube adjacent to each J-bracket. A swing arm pivoted on each clamp assembly is rotated into a position over the encircling portion of the J-bracket so as to both trap the bracket against the clamp and against the tube. Quick release and reattachment is achieved simply by rotating the swing arms off or on the J-hooks.

Typically, four sets of cooperating J-brackets and clamp assemblies may be used for a seat cushion or back rest. Attachments that are smaller may require fewer sets, while more sets may be appropriate for high stress connections. In any case, the release process is so fast and easy that the designer is free to use as many sets as are appropriate for the situation. Inherently, the design allows small positional errors in the location of the J-brackets without compromising operation or strength so that manufacture is made easier and less expensive.

Additional benefits and advantages are elucidated in the drawings and in the detailed description that follows.

BRIEF DESCRIPTION OF THE DRAWINGS

.

FIG. 5 is a more detailed side view of the swing arm as seen from line 5—5 FIG. 3;

FIGS. 6 and 7 are sectional views taken on lines 6—6 and 7—7 in FIG. 4 to better disclose the internal structural details of the brackets, clamp assembly, and swing arm.

DETAILED DESCRIPTION OF THE INVENTION

Figure 1:
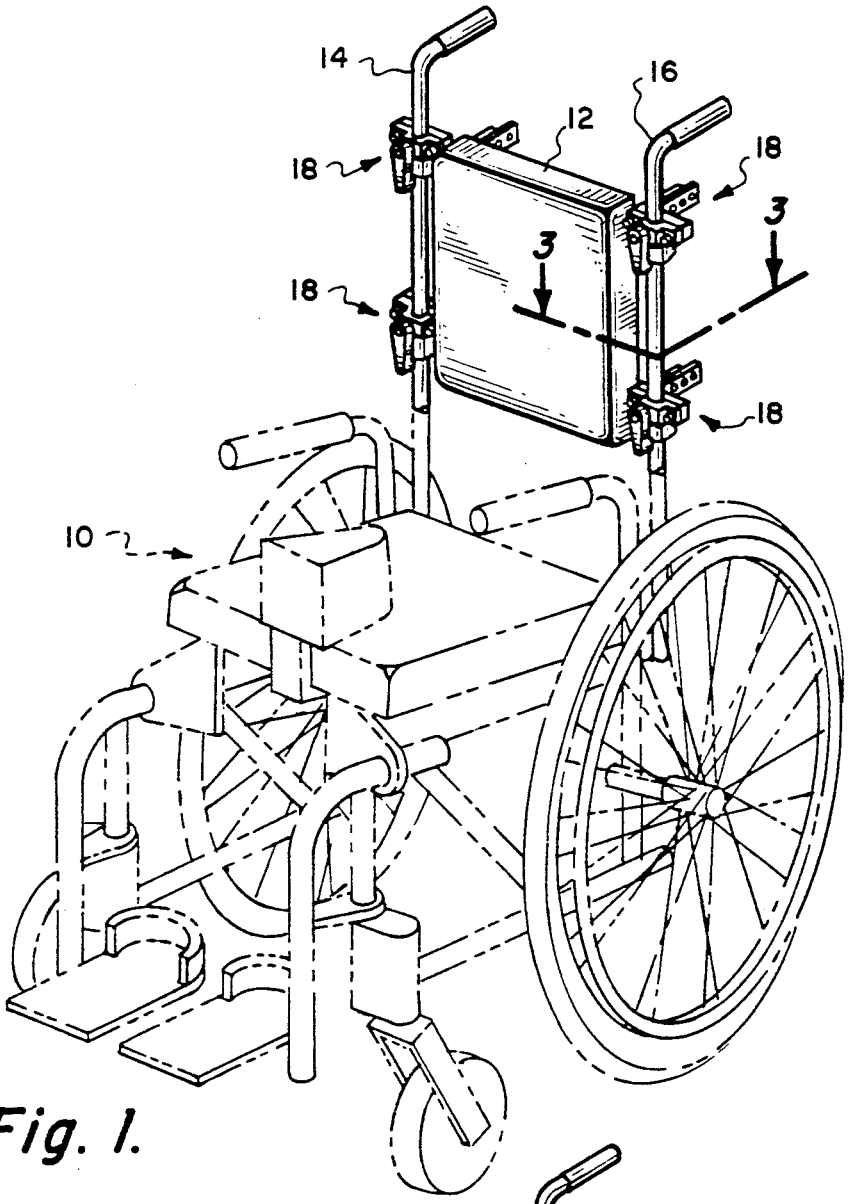
FIG. 1 shows a wheelchair with an exemplary detachable component, a back rest, fastened to the frame of the chair with four sets of quick release clamp and hook assemblies of the present inventive design.

FIG. 1 shows a typical wheelchair 10 with a detachable backrest 12 thereon. Backrest 12 is connected to two vertical tubular frame members 14 and 16 by means of four sets of quick release clamp and J-bracket assemblies 18.

Figure 2:
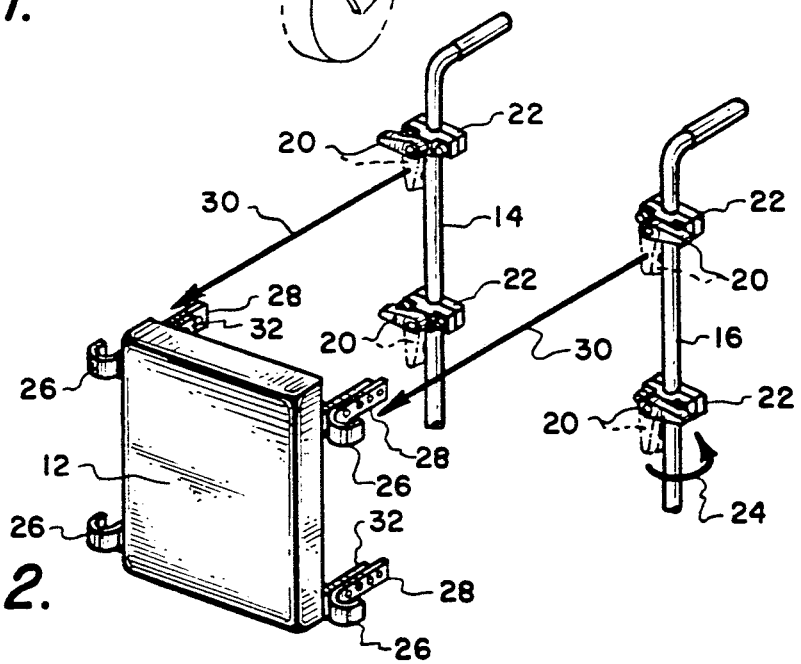
FIG. 2 is a fragmentary view showing the back rest removed from the chair frame after rotation of the swing arms on the clamps.

As seen in FIG. 2, backrest 12 is removed by rotating the swing arms 20 on clamps 22 in the direction indicated by arrow 24 so as to uncover the encircling portion 26 of J-shaped brackets 28 and pulling backrest 12 away as indicated by arrows 30. The clamp and bracket assembly is shown in greater detail in FIGS. 3 and 4.

Figure 3:
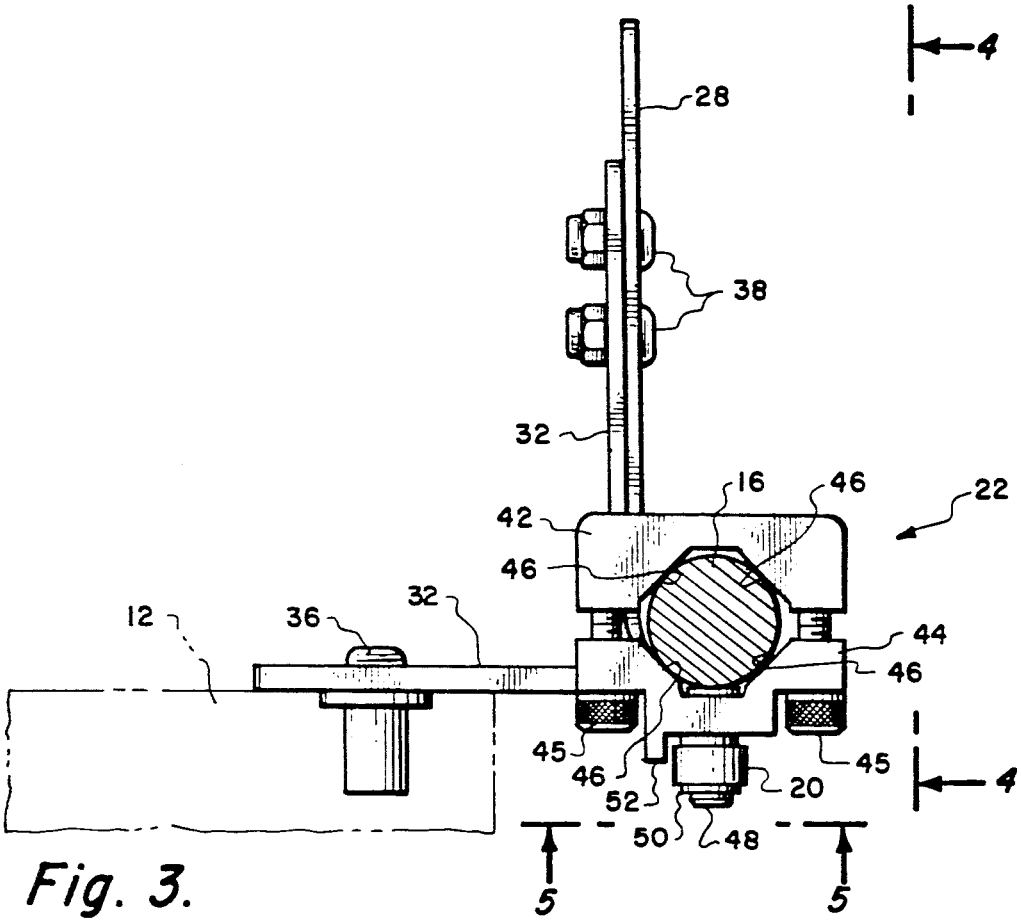
FIG. 3 is a top view of one of the clamp and J-bracket sets as seen from the view line 3—3 in FIG. 1.
Figure 4:
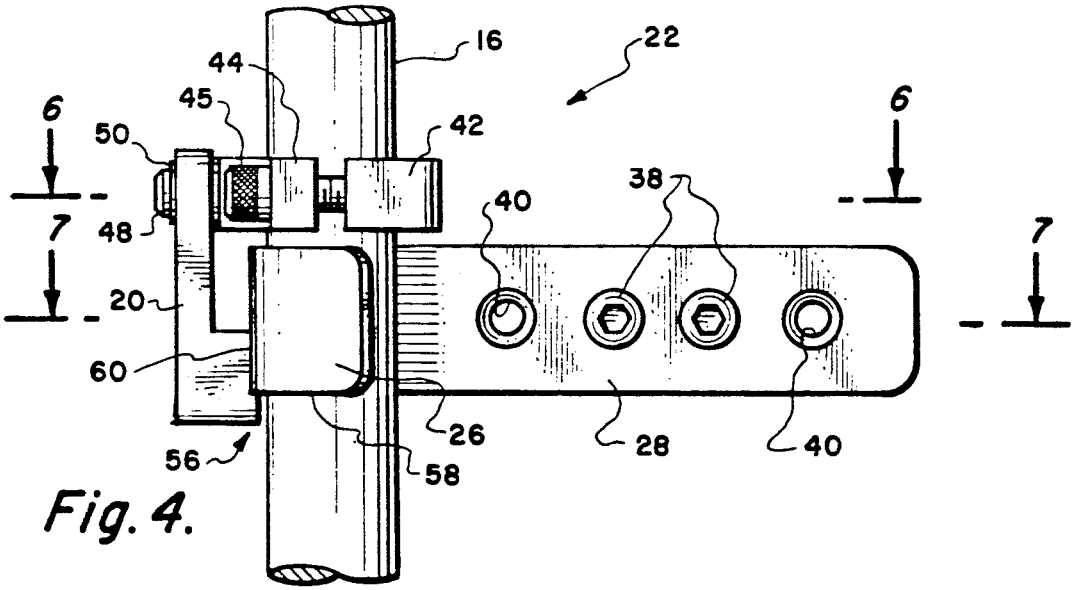
FIG. 4 is a side view of the set as it would appear from view line 4—4 in FIG. 3.

Referring to FIGS. 3 and 4, an angle bracket 32 is secured into the backrest 12 with a conventional screw and anchor 36 in a manner well known to those skilled in the art. Bracket 32 is, in turn, bolted to J-bracket 28 with a pair of screws and lock nuts 38. Both angle bracket 32 and J-bracket 28 are provided with additional holes 40 that allow other relative positions for the two brackets.

J-bracket 28 has a tube encircling portion 26 that wraps part way around tube 16 so as to provide location of bracket 28 relative to the tube in the direction perpendicular to the plane of the drawing in FIG. 4. Clamp 22 comprises a pair of yoke members 42 and 44 disposed about tube 16 and squeezed onto the tube with a pair of screws 45. Yokes 42 and 44 have angled interior surfaces 46 that permit the clamp 22 to firmly grasp various diameter frame tubes. A pivot pin 48 supports swing arm 20 for rotation on yoke member 44. Arm 20 is retained on pin 48 by a snap ring 50, in one embodiment of the invention, giving a tight fit and sufficient friction to keep the swing arm 20 in any selected position but still allowing rotation by hand. Another embodiment is described below with respect to FIG. 8.

In FIG. 5, it may be seen that swing arm 20 follows an arcuate path 54 when pivoted on pin 48 and is prevented from over rotation by a stop 52 on yoke 44. Because of the curved portion 26 of J-bracket 28, a small retaining catch 56 can follow arcuate path 54 to a position where it traps the edge 58 of J-bracket 28.

Catch 56 is best seen in FIG. 4. Encircling portion 26 is held between catch 56 and the main body of clamp 22. Also, encircling portion 26 is firmly held against tube 16 by a raised surface 60 on swing arm 20 that comes to rest on top of J-bracket 28 at the end of arcuate path 54. Hence, the J-bracket and the attached backrest are secured to tube 16 in all three axes.

Sectional FIGS. 6 and 7 show additional interior details of the invention such as screws 45 and 36, adjustment holes 40, raised surface 60, and catch 56.

Figure 8:
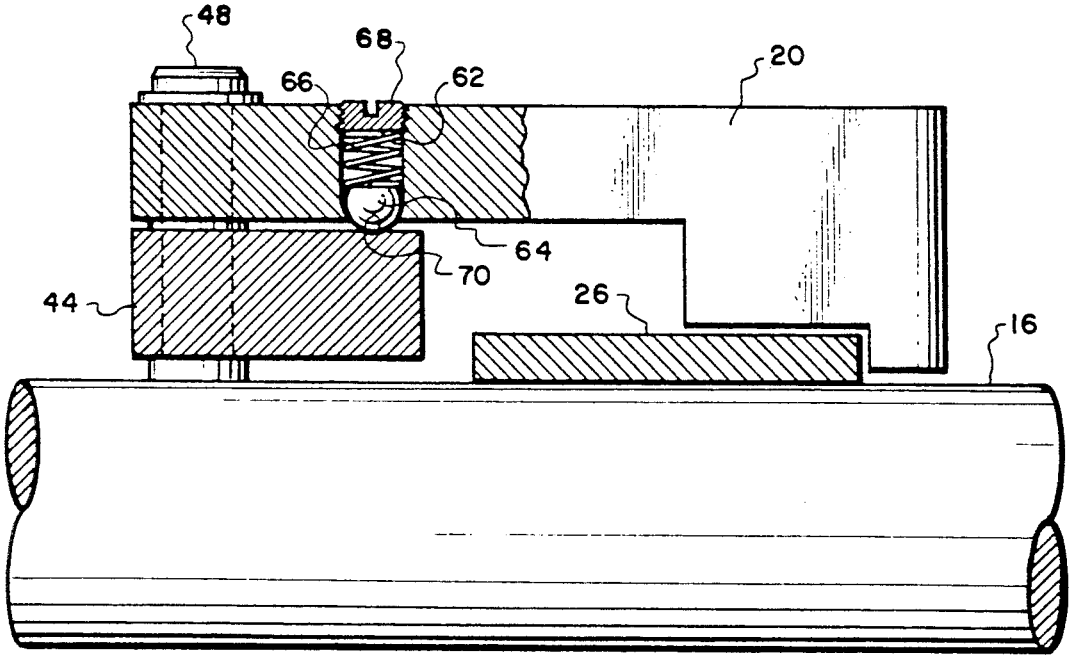
FIG. 8 is a sectional fragmentary view showing an alternative embodiment of the invention in which the swing arm is additionally located by a ball and detent mechanism.

FIG. 8 shows an alternative embodiment of the invention in which swing arm 20 is further secured in position by a ball and detent arrangement. A hole 62 contains a ball 64 urged downward by a spring 66 and a set screw 68. Yoke 44 includes a small recess or detent 70 into which ball 64 drops to help hold arm 20 in place over bracket 26. Alternatively, the spring and ball could be mounted in yoke 44 so as to engage a detent in swing arm 20. Functionally, these two configurations are equivalent.

Of course, some of the minor details in the drawings are not essential to the practice of the invention. Many variations will be conceived by those skilled in the art. For example, other clamp designs that fasten securely to the frame near the bracket and provide support for an arm that swings over and around the bracket would serve as well. In the preferred embodiment, the encircling portion 26 has a diameter sufficient to accommodate the largest diameter frame tube and works equally well on smaller diameter tubes too. The brackets connected directly to the backrest are, of course, tailored to the backrest shape and would vary for other detachable components. Accordingly, limitation only in accordance with the appended claims is intended.

We claim:

1. In combination with a wheelchair having tubular frame members, a quick release bracket assembly for mounting detachable components to the frame members comprising in combination:

a plurality of bracket means connected to the component to be attached to the frame, each of said bracket means having a curved portion of diameter greater than the outside diameter of the tubular frame members, adapted to partly encircle a frame member with the interior concave surface of the curved portion resting against the frame member in at least one contact location; and a plurality of clamping means adapted to be mounted securely about the outside surface of said frame members adjacent to where said curved portion encircles the frame member, each of said clamping means having a swing arm rotating about a pivot pin through one end of the swing arm, said pivot pin being connected to said clamping means such that the swing arm is operable to swing into position over the curved portion, in contact with and against the exterior convex surface of the curved portion, generally opposite said contact location so as to hold said curved portion against said frame member and next to said clamping means.

2. The assembly of claim 2 in which said swing arm has a projecting catch member at the end remote from said pivot end that engages the side of said curved portion remote from said clamping means so as to hold said curved portion next to said clamping means.

3. The assembly of claim 2 including a pressing means on said swing arm intermediate the pivot end and the catch member adapted to swing over and press said curved portion against said frame member.

4. The assembly of claim 3 in which said clamping means comprises a pair of yokes disposed about said frame member and urged into compressive contact with the frame member by screw means connecting said yokes, said yokes having beveled surfaces operable to contact frame members of varying diameters, said swing arm mounted on one of said yokes.

5. The assembly of claim 4 in which the pivot pin is engaged with the swing arm tightly enough to produce frictional forces sufficient to allow rotation of the arm but keep the swing arm in the selected position.

6. The assembly of claim 4 in which said pressing means comprises a spring urged ball in the movable swing arm adapted to engage a detent in said one yoke so as to help hold the swing arm in position over said one yoke.

7. An easy release, clamp and bracket, attachment system for mounting detachable components, such as seats and backs, to wheelchair frames comprising:

a clamp member adapted to be secured about the outside surface of the frame of the wheelchair and having a pivoting member thereon that is movable to a position adjacent the clamp member and also adjacent to the frame;

bracket means adapted to be fastened to the detachable component, said bracket means having a curved portion of diameter sufficient to extend at least half way around the frame at said adjacent position and under said pivoting member so that the concave side of said curved portion is held in contact with the wheelchair frame by said pivoting member in at least one location, said pivoting member pivoting about a pivot pin connected to said clamp member and into position beyond said bracket means so as to hold said bracket member proximate to the clamp member.

8. The system of claim 7 including a surface on said pivoting member located to move over and hold said bracket member against the frame.

9. The system of claim 8 including a spring urged ball and detent mechanism between said pivoting member and said clamp member to help hold the pivoting member at a selected position.

10. The method of securing detachable components to a wheelchair frame made from tubular members of varying diameter comprising the steps of:

attaching clamps about the outside surface of the frame members at a plurality of first selected locations;

positioning a plurality of J-shaped brackets connected to a detachable component about said frame members at positions adjacent to said selected locations; and rotating swing arms on said clamps to a position over and beyond said J-shaped brackets so as to hold the brackets against the frame members and proximate to the clamps.

11. In combination with a wheelchair having tubular frame members, a quick release bracket assembly for mounting detachable components to the frame members comprising in combination:

bracket means connected to the component to be attached to the frame, said bracket means having a curved portion adapted to partly encircle a frame member; and clamping means adapted to be mounted securely to said frame member adjacent to said curved portion, said clamping means having a swing arm pivotally mounted thereon operable to swing into position to hold said curved portion proximate said frame member and proximate said clamping means, and in which said swing arm rotates about a pivot pin through one end of the swing arm, said pivot pin connected to said clamping means and further in which said swing arm has a projecting catch member at the end remote from said pivot end that engages the side of said curved portion remote from said clamping means so as to hold said curved portion proximate to said clamping means.

12. The assembly of claim 11 including a raised surface on said swing arm intermediate the pivot end and the catch member adapted to swing over and hold said curved portion against said frame member.

13. The assembly of claim 12 in which said clamping means comprises a pair of yokes disposed about said frame member and urged into compressive contact with the frame member by screw means connecting said yokes, said yokes having beveled surfaces operable to contact frame members of varying diameters, said swing arm mounted on one of said yokes.

14. The assembly of clam 13 in which the pivot pin is engaged with the swing arm tightly enough to produce frictional forces sufficient to allow rotation of the arm but keep the swing arm in the selected position.

15. The assembly of claim 13 including a spring urged ball in one of the relatively movable swing arm and yoke structures adapted to engage a detent in the other structure so as to help hold the swing arm in a selected position.

16. An easy release attachment system for mounting detachable components, such as seats and backs, to wheelchair frames comprising:

a clamp member adapted to be secured about the frame of the wheelchair and having a pivoting member thereon that is movable to a position adjacent the clamp member and also adjacent to the frame; and bracket means adapted to be connected to the detachable component and also adapted to extend partly around the frame at said adjacent position and under said pivoting member and in which said pivoting member pivots about a pivot pin connected to said clamp member and into position beyond said bracket means so as to hold said bracket means proximate to the clamp member and including a surface on said pivoting member located to move over and hold said bracket member against the frame and further including a spring urged ball and detent mechanism between said pivoting member and said clamp member to help hold the pivoting member at a selected position.

* * * * *